US005718416A

United States Patent [19]

Flisakowski et al.

[11] Patent Number: 5,718,416

[45] Date of Patent: Feb. 17, 1998

[54] LID AND CONTAINMENT VESSEL FOR REFINING MOLTEN METAL

[75] Inventors: Peter J. Flisakowski; David C. Griffith, both of Spokane, Wash.

[73] Assignee: Pyrotek, Inc., Spokane, Wash.

[21] Appl. No.: 594,727

[22] Filed: Jan. 30, 1996

[51] Int. Cl.[6] ..... C21C 7/00

[52] U.S. Cl. ..... 266/217; 266/275; 432/250

[58] Field of Search ..... 266/216, 217, 266/242, 275, 287, 225; 432/250, 248

[56] References Cited

U.S. PATENT DOCUMENTS

| | | | |
|---|---|---|---|
| 3,743,263 | 7/1973 | Szekely | 266/217 |
| 3,870,511 | 3/1975 | Szekely | 75/680 |
| 4,021,026 | 5/1977 | Szekely | 266/275 |
| 4,191,486 | 3/1980 | Pelton | 403/343 |
| 4,203,581 | 5/1980 | Pelton | 266/217 |
| 4,443,004 | 4/1984 | Hicter et al. | 266/226 |
| 4,624,128 | 11/1986 | Pelton | 73/19 |
| 4,685,822 | 8/1987 | Pelton | 403/343 |
| 4,941,647 | 7/1990 | Pelton | 266/285 |
| 4,998,710 | 3/1991 | Pelton | 266/275 |
| 5,085,536 | 2/1992 | Pelton | 403/343 |
| 5,198,180 | 3/1993 | Pelton | 266/225 |
| 5,275,385 | 1/1994 | Pelton | 266/233 |
| 5,275,844 | 1/1994 | Moore | 427/255.2 |

FOREIGN PATENT DOCUMENTS 0 238 884 9/1987 European Pat. Off. .

OTHER PUBLICATIONS

Efficiency Through Know-How, The Hydro Aluminum Hycast® Metal Refining System, Hydro Aluminum Hycast a.s., Dec. 1994.

*Primary Examiner*—Scott Kastler

*Attorney, Agent, or Firm*—Wells, St. John, Roberts, Gregory & Matkin, P.S.

[57] ABSTRACT

Disclosed is a dome lid and a containment vessel for use in combination with a molten metal refinement system for the refinement and purification of molten metal by degassification. Further disclosed is an apparatus for refining molten metal, which includes a molten metal refinement system in combination with a containment vessel having a molten metal inlet, a molten metal outlet, a lower section which includes one or more metal refinement compartments and an upper section which includes an elevated ceiling, inwardly sloped outer walls and access ports in the sloped outer walls. The molten metal particularly includes aluminum.

12 Claims, 7 Drawing Sheets

LID AND CONTAINMENT VESSEL FOR REFINING MOLTEN METAL

TECHNICAL FIELD

This invention generally pertains to a new and improved lid and containment vessel for refining molten metal. More particularly, this invention pertains to a lid and containment vessel which acts in combination with a rotary gas dispersion device for the in-line treatment or purification of metal.

BACKGROUND OF THE INVENTION

In order to achieve the highest quality final metal or aluminum products, the molten metal used to form the intermediate billets and ingots must contain only a minimal amount of impurities such as sodium, hydrogen and non-metallic inclusions. Although this invention has potential applications to other metals, the preferred embodiment of this invention is for use in the refinement of aluminum, it will therefore be the metal referred to herein.

One way to remove impurities from molten aluminum is based upon gas floatation principles, generally referred to as degassification. In the degassification process, the aluminum flows through a degassification vessel or tub. The aluminum in the tub is subjected to a rotor action and the introduction of tiny gas bubbles such as argon and chlorine. The gas bubbles are finely dispersed in the molten metal. As the dispersed gas bubbles rise within the molten aluminum, the bubbles serve to remove impurities from the molten aluminum.

Examples of various prior apparatus for refining molten metal by degassification are illustrated in the following United States patents: (a) U.S. Pat. No. 5,234,202, Pelton, Aug. 10, 1993; (b) U.S. Pat. No. 4,784,374, Pelton, Nov. 15, 1988; (c) U.S. Pat. No. 4,373,704, Pelton, Feb. 15, 1983; and (d) U.S. Pat. No. 4,040,610, Szekely, Aug. 9, 1977.

Very generally, the hydrogen impurities contained within the molten aluminum are removed through dispersion in the bubbles and the alkali metals are removed by chemical reaction with the chlorine in the treatment gas. Other inclusions in the aluminum are trapped by the bubbles and buoyed or floated to the top. The smaller other inclusions are peripherally intercepted by the rising bubbles whereas the larger of the other inclusions are removed by the inert impact with the rising bubbles.

In order to maximize the degassification process, one or more rotor assemblies are placed in the molten aluminum and rotated while the related process gas is dispersed through the rotor. The rotors are generally made of graphite and rotated in the range of two hundred to five hundred revolutions per minute.

There are two types of rotor assemblies: (a) rotor assemblies wherein the rotating column or shaft is protected or shielded from the molten metal, except at the rotor blades, generally referred to as a stator or shielded rotor assemblies; and (b) rotor assemblies which have no stator and the rotating shaft or column rotates unprotected within the molten metal.

Illustrative of a stator or shield which protects the rotating rotor shaft from the molten metal is the sleeve in U.S. Pat. No. 4,040,610 (item 4 in that patent), issued to Szekely, Aug. 9, 1977.

During the degassification process, the molten aluminum is generally enclosed within the refining or containment vessel by the combination of the lower tub assembly and the upper lid assembly of the vessel. The prior art vessel lids have generally been mounted directly on the vessel tub and insulated on the interior side of the lid with known refractory, similar to the rest of the tub.

In order to gain access to the interior of most degassification vessels, mechanical means such as hydraulic lifting must be employed to lift the large and heavy prior art lids. The time, additional equipment expense and burden of mechanical lifting devices required to gain access to the interior of the vessel is unnecessarily burdensome.

Furthermore, the interior surface of the flat prior art lid is in close proximity to the upper surface of the molten metal when the vessel is near capacity, making it susceptible to receive and accumulate splashing molten metal. When the splashed metal on the interior surface of the vessel lid builds up, it can cause problems which then require that the metal be removed and the vessel cleaned.

For vessels in which a non-stator or non-shielded rotary gas dispersion device is used, the rotating column or shaft of the rotor is directly exposed to the molten metal and the spinning action of the rotor causes metal splashing and excess buildup of aluminum on the ceiling or interior surface of the lid. There is generally more splashing and excess buildup of metal on the interior ceiling of the vessel for vessels in which a non-stator or non-shielded rotary system is used.

It is very important for the end user to minimize the downtime of all components of the manufacturing system, including the containment vessels. The cost of downtime in molten metal production facilities can far exceed the capital cost of many of the individual components and increasing the life of components such as this refinement vessel is critical to a component's utility in and benefit to the production line.

Throughout aluminum refinement vessels, graphite is used in various components and is considered to be a critical wear part. Graphite readily oxidizes and has a much shorter life when in the presence of oxygen. Certain other gas mixtures create a far superior environment for extending the life of the graphite. In the environment of the refinement vessel, the graphite parts wear longer when the vessel is sealed and when process control gases can be utilized to extend the life of the graphite. It is therefore an objective of all such refinement systems to isolate the graphite from oxygen by covering the graphite with refractory, however, graphite remains exposed.

Unfortunately, however, there is insufficient volume above the molten metal within existing containment vessels and lid designs to sustain an adequate level of control gases to materially impact the life of the graphite. Prior lids have further been insufficiently sealed to adequately keep oxygen out of the vessel or to sufficiently keep the control gases in the vessel.

Further, prior lids have not utilized process gas exhausts systems directly connected to the containment vessel to remove the gases from the containment vessel. Instead, the process gases from the refinement, such as chlorine, are induced out of the doors and openings of the vessel by a vent hood placed above the vessel. The hood draws in air from the facility and hopefully by drawing that air, induces a sufficient amount of chlorine and other gases from the vessel and through the exhaust.

It is therefore an objective of this invention to provide a mechanism for the direct connection of the containment vessel to the gas exhaust system to directly remove the chlorine and other dangerous gases from the containment vessel into the manufacturing facilities gas exhaust system.

These refinement vessels exist in two basic modes, the first during the refinement of the molten metal and the second in an idle mode. During the refinement of aluminum for instance, typically an inert gas such as argon, combined with an active gas such as chlorine, are dispersed into the vessel through the rotary gas dispersion device. On the other hand, when the vessel is in the idle mode, gases such as nitrogen and cover gases can be introduced into the vessel through gas input ports.

It therefore becomes evident that the ability to control the flow of the exhaust gases from the vessel can be important in controlling the gases in the vessel, the oxidation of the graphite and the safe exhaust of process gases.

There has been a long felt and ongoing need to increase the useful life of all components, but particularly graphite, in refinement vessels, and this need has not heretofore been fulfilled. It is therefore an objective of this invention to provide a refinement vessel which allows the wear life of the graphite to be increased in the refinement vessel. This invention particularly accomplishes this objective by providing a lid which achieves a much better seal with the vessel tub, thus reducing air infiltration.

This invention further accomplishes this by providing a substantially greater interior lid volume (approximately four times the volume of prior lids) combined with control gas ports through which to supply and/or control the process gasses. The greater interior lid volume allows more control gas to be included in within the vessel and more therefore available to displace oxygen in the vessel and deter the oxidation of the graphite.

There are various known exhaust gas control systems which can be connected to or combined with this invention to increase the wear life of the graphite components. Ideally, the manufacturing facility's existing exhaust control system can be utilized by operatively connecting it to the lid assembly of this invention.

There has been a long felt yet unfulfilled need for an aluminum refinement or degassification vessel which can be used in combination with rotor gas dispersion devices and which will not result in the excess buildup of aluminum or molten metal on the vessel ceiling. An example of a non-stator rotary gas dispersion device which this invention will operate in combination with is one manufactured by Pechiney Aluminum Engineering of France, and generally referred to as the Alpur In-Line Metal Treatment System.

There has further been a long-felt need for such a degassification vessel in which the interior of the vessel is more readily and more easily accessible, without the necessity for substantial mechanical or hydraulic lifting means to lift the lid for access and for access on two or more sides. An example of prior art vessel lids and the lifting required to adequately access the interior of the vessel is shown in U.S. Pat. 4,443,004, issued to Hicter, et. al. on Apr. 17, 1984, and which is incorporated herein by this reference. FIG. 2 of the Hicter patent illustrates the lid (item 24 in that patent) in its downward and upward tilted positions and the mechanical and hydraulic equipment required to lift the lid.

There is still further a need for such a degassification vessel in which the interior of the vessel is accessible in such a way that there is adequate space or air insulation above the capacity level of the molten level so that operators can access the interior and have room to work above the level of the molten metal.

There is a still further need for such a degassification vessel in which the interior upper surface of the vessel is less susceptible to receiving and accumulating molten metal.

Although these aforementioned needs have been recognized, they have not been adequately fulfilled until this invention.

Additional objects and accomplishments of this invention are to provide a molten metal degassification vessel for use in combination with a molten metal refinement system:

(a) Wherein the interior upper surface of the vessel is less susceptible to receiving and accumulating molten metal. This invention accomplishes this objective by providing an elevated interior ceiling surface with sloping surfaces towards the outer edges of the ceiling surface, or two or more sides. This minimizes the molten metal received by the ceiling and accumulated thereon.

(b) Which improves the ability of an operator to access the interior of the vessel easily by providing a plurality of access ports or lids with handles to lift the port doors. This substantially improved accessibility of the interior upper area of the vessel is accomplished by providing an elevated and sloped ceiling which receives and accumulates substantially less molten metal, especially in non-stator or non-shielded rotary gas dispersion devices where buildup is more of a problem.

(c) Which greatly reduces or eliminates the mechanical or hydraulic lifting equipment necessary to lift the lid to gain access to the interior of the vessel.

(d) Which substantially improves the ergonomics for operators accessing the interior upper area of the vessel. This is accomplished by arranging the access ports or doors at an upward angle toward the center of the vessel to reduce the restrictions of working under more ceiling area and the additional reaching the operator is required to do when working with the old lid systems. This is also accomplished by providing more than one and up to three access doors or ports for better access to the interior of the vessel.

(e) Which eliminates the need to use special tools to open port doors to the vessel.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Many of the fastening, connection and other means and components utilized in this invention are widely known and used in the field of the invention described, their exact nature or type is not necessary for an understanding and use of the invention by a person skilled in the art or science, and they will not therefor be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefor be discussed in significant detail.

Figure 1:
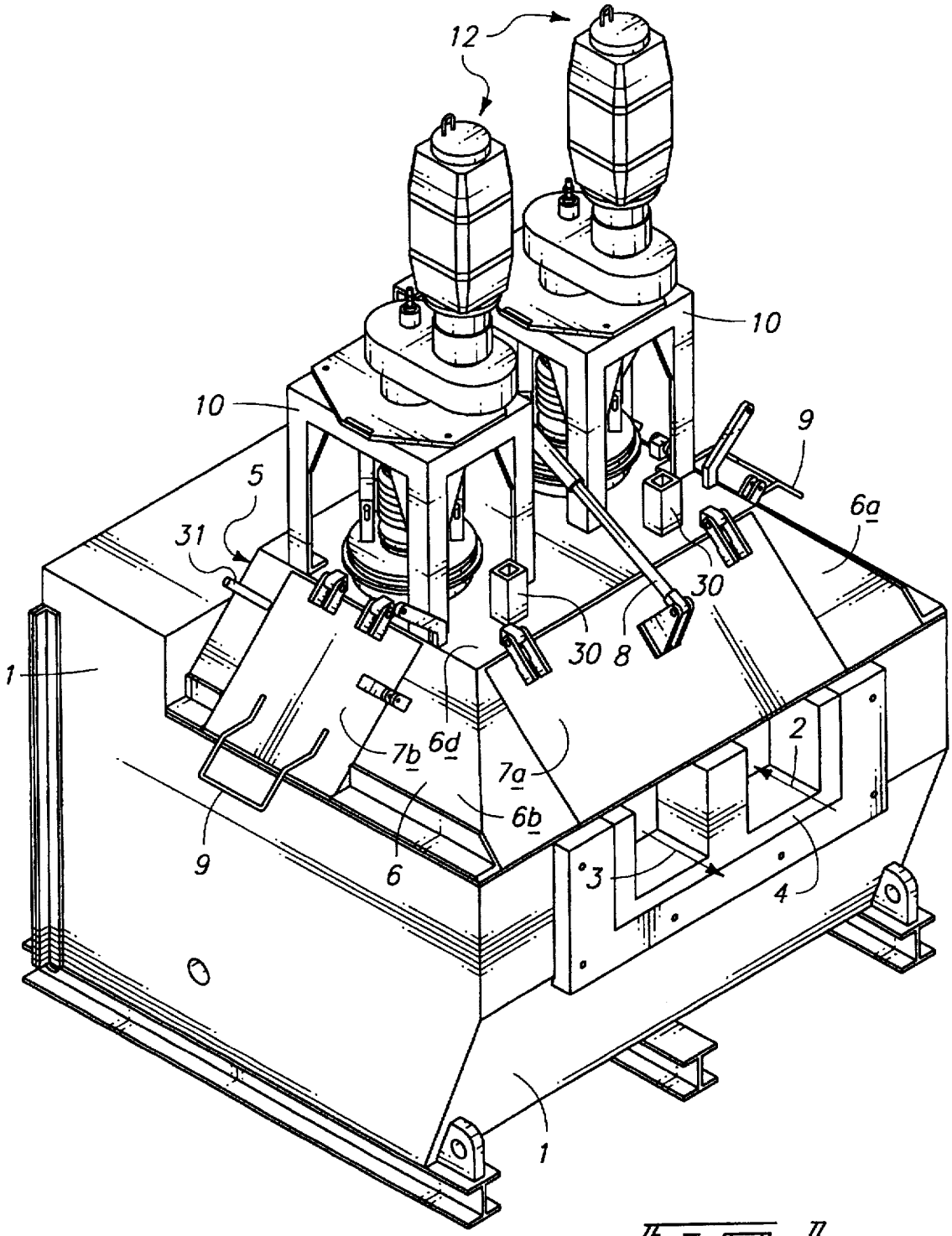
FIG. 1 is a perspective elevation view of the molten metal refinement system and containment vessel provided by this invention, illustrating the tub, the lid and the rotary gas dispersion devices.

FIG. 1 is a perspective view of one embodiment of the invention. The lower part of the refinement vessel is generally referred to as the tub assembly 1. The tub assembly 1 is a two stage refining vessel wherein the aluminum or other molten metal is introduced into the first refinement stage or first refinement compartment 20 of the vessel through metal inlet 2.

The lid assembly will be referred to herein as the dome lid assembly. Dome, as used herein, will be used much more broadly than its ordinary meaning as the dome lid assembly is not hemispherical.

Instead, dome is used more broadly to include all elevated lid systems and applies whether the lid is hemispherical, frustoconical, box-shaped or any other imaginable specific shape or configuration.

The preferred elevation of the roof of the lid assembly is approximately eight inches.

The preferred embodiment of the dome lid assembly is specifically designed to attach to and function in combination with tub assembly 1 referred to in the industry as SNIF units. SNIF is an acronym for Spinning Nozzle Inert Flotation degassing systems and is a trademark of Union Carbide, or its successors in interest. The "R" Series of SNIF unit tubs runs in two variations, the "U" units and the "S" unit.

After being refined in the first refinement compartment 20, the metal flows to the second refinement compartment 21, where it is further refined before exiting through the metal outlet 3. The design of the refinement vessel is such that the inlet and outlet for the metal can be reversed to accommodate the particulars of the facility in which it is used, i.e. the metal inlet 2 can be used as an outlet and the metal outlet 3 can be used as an inlet. The first refinement compartment then becomes the second and visa versa.

Lining most of the area where metal contacts the refinement vessel is known refractory material, such as the port refractory 4 shown in FIG. 1.

In the typical refinement vessel, the rear portion of this two stage refinement vessel houses the heating elements. The rear portion of the vessel typically contains a large block of graphite with certain openings therein to allow heating elements to protrude through to transfer heat to the aluminum or other metal being processed. If the graphite block becomes excessively oxidized, the openings in the graphite can allow molten metal to flow through the enlarged openings and to the heater unit, thereby damaging the heater unit and requiring repairs and/or maintenance.

FIG. 1 illustrates the dome lid assembly 5 provided by this invention, securely attached to the tub assembly 1 such that there is an effective air seal between the two. This sealed connection further helps to maintain the interior of the dome lid free of graphite-damaging oxygen.

The dome lid assembly 5 can be securely and sealably attached to the upper outer surface of the containment vessel tub assembly 1 by numerous different known means. The dome lid body 6 has four outer walls, a lid body front wall **6*a*, two lid body side walls 6*b* (see FIGS. 3 and 4) and a lid body rear wall 6*c* (see FIG. 5), in addition to the lid body roof 6*d*. FIG. 1 illustrates how the lid body front wall 6*a* and the two lid body side walls 6*b*** are inwardly sloping.

The size and elevated configuration of the dome lid assembly shown in FIG. 1 results in over four times the volume of space above the molten metal and beneath the interior walls of the dome lid, i.e. within the dome. The approximate volume of the dome lid assembly in this invention is approximately nine and nine-tenths cubic feet whereas the approximate volume of prior lids utilized with the same or similar tub assemblies is approximately two and two-tenths cubic feet. This increased volume allows for the introduction and/or control of over four times the amount of non-oxygen control gas that can be introduced and/or utilized to extend the life of the graphite in the vessel.

Gas exhaust ports 30 can be used to facilitate the direct and controlled exhaust of process gases from the vessel, whereas the gas inlet nozzles 31 can be utilized for the introduction of gases within the refinement vessel to deter the oxidation of the graphite. Existing vessel designs do not have sufficient volumetric space within which to provide sufficient control gases to help conserve the graphite within the vessel.

This invention allows the manufacturer to attach its existing exhaust gas control system to the refinement vessel and to thereby better control the exhaust of gases. This invention combined with a process gas control system has the additional safety benefit of reducing the amount of chlorine which escapes from the refinement vessel and into the manufacturer's facility during the process. An example of a gas control systems that can be utilized are the flow rate gas panels marketed by Praxair and known in the industry.

Mounted on the dome lid assembly 5 are three access doors, a front access door **7*a* and two side access doors 7*b***. The three access doors, mounted on the inwardly sloping dome lid assembly walls, are also inwardly sloping.

The front access door **7*a* comprises a substantial area on the dome lid front wall 6*a* and can consequently be very heavy. In order to more easily open the front access door 7*a*, a hydraulic cylinder assembly 8 is provided. The side access doors 7*b* are smaller than the front access door 7*a* and much more easily handled by workmen and handles 9 are therefore provided to open the side access doors 7*b***, without the need for mechanical assistance.

Mounted on the lid body roof **6*d* are two rotary gas dispersion devices 12, one for each refining compartment or stage. An example of a rotary gas dispersion device 12 which can be used in the combination which this invention comprises is disclosed in the Gimond et al. patent, U.S. Pat. No. 4,426,068 (hereby incorporated by this reference), and assigned to and available through Pechiney, Paris, France. There are other rotary gas dispersion devices 12** available from Pechiney, generally under its ALPUR trademark.

This invention overcomes the numerous problems inherent in combining the Union Carbide SNIF tub units with the Pechiney ALPUR rotary gas dispersion devices 12, including, among others, those problems associated with splashing and metal buildup because the ALPUR devices do not have a stator. The rotary gas dispersion devices for use in the combinations defined by this invention can however be the type with or without a protective stator or shield, and there are numerous types available.

The rotary gas dispersion devices 12 are mounted on rotor tower mounts 10. The tower mounts 10 are preferably located on the roof **6*d* such that the rotary gas dispersion devices 12 mounted thereon are centered over and within each of the two refining compartments, placing the rotor blades approximately four inches above the bottom surface or floor of the vessel tub assembly 1**.

Figure 7:
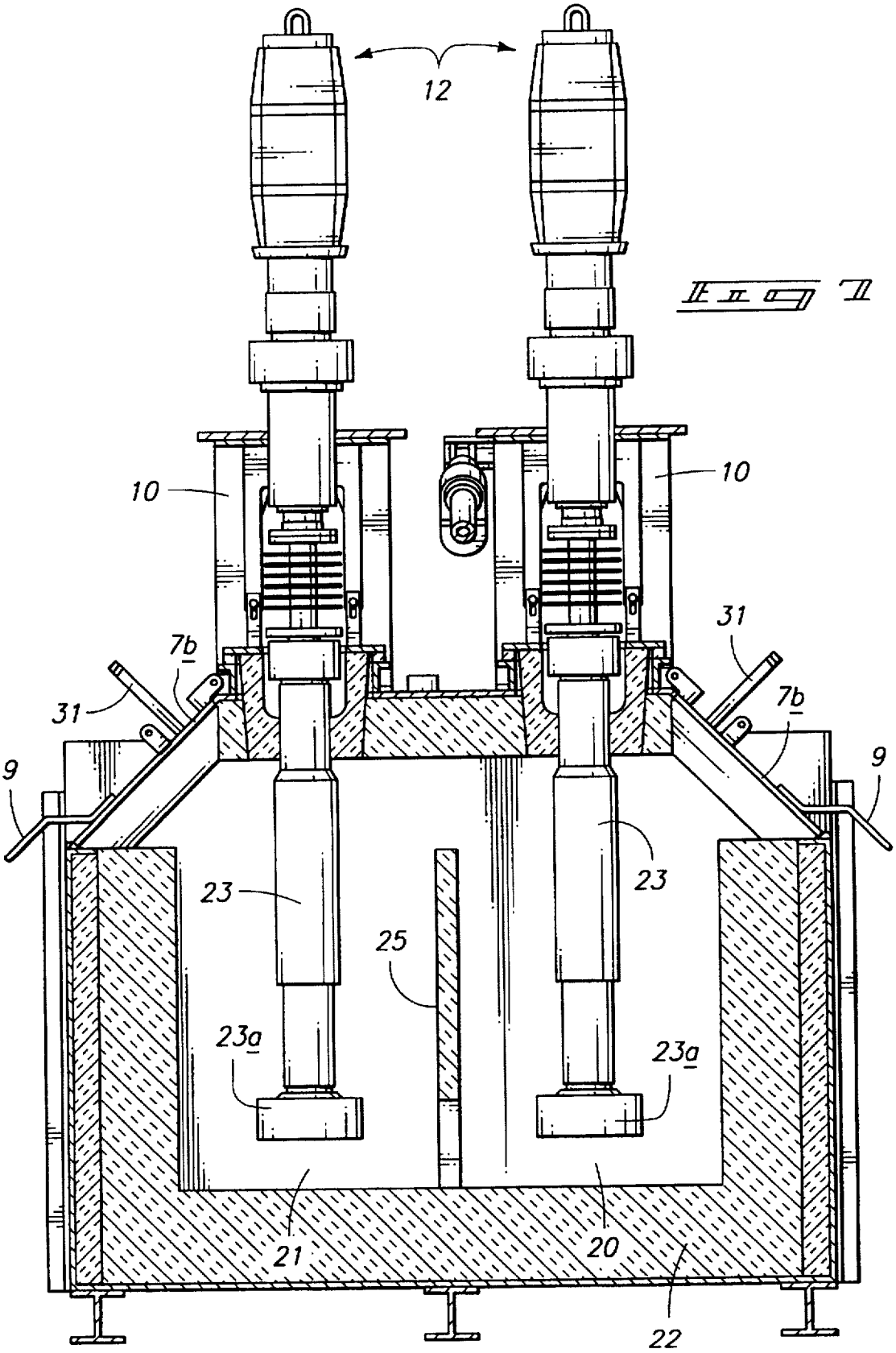
FIG. 7 is a cross sectional view (7—7 from FIG. 3) of one application of the molten metal refinement system and containment vessel of this invention, illustrating the internal area of the tub, including the rotary gas dispersion devices.

The rotary gas dispersion devices 12 are more fully illustrated by referring to FIG. 7.

Figure 2:
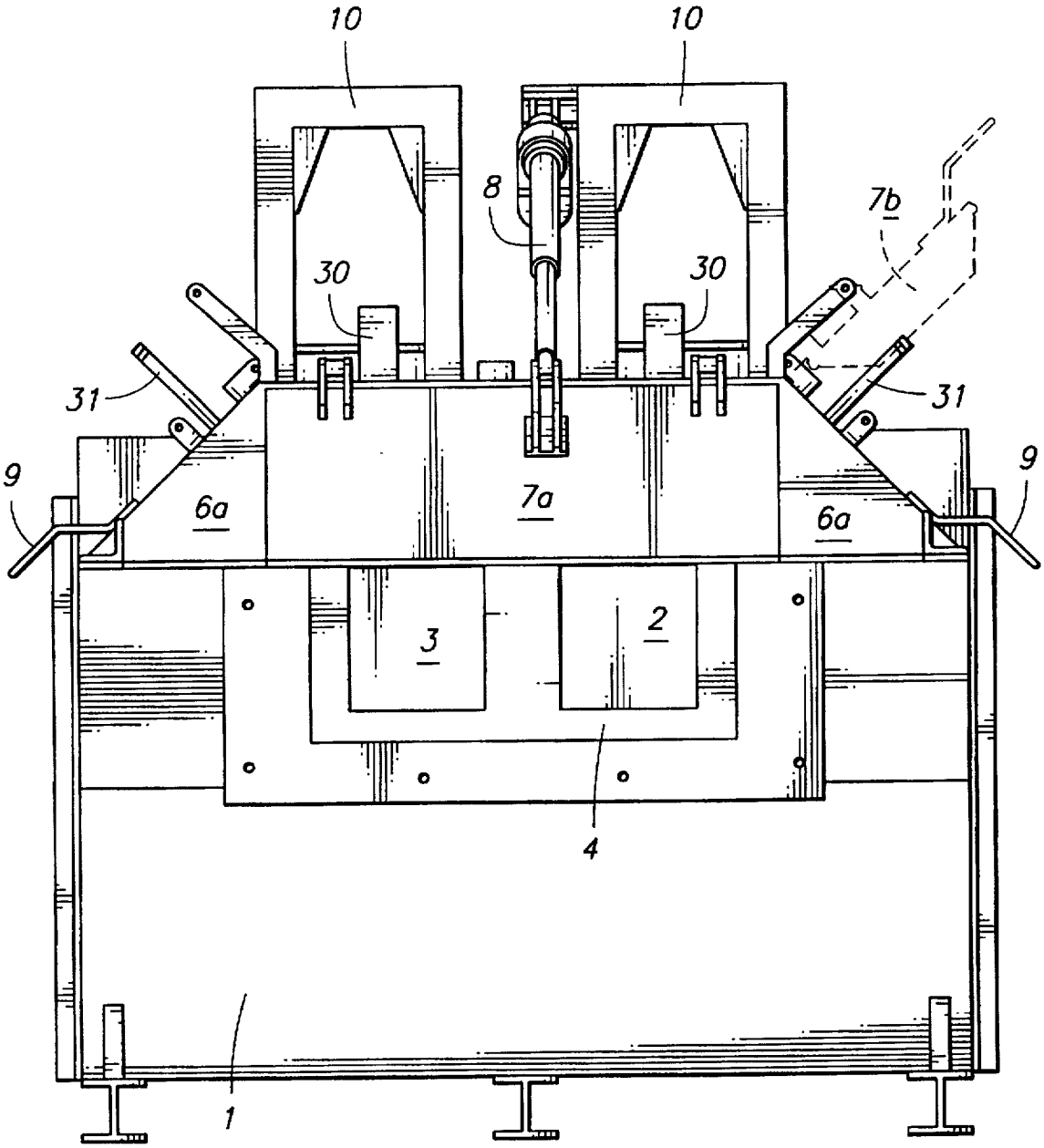
FIG. 2 is a front side elevation view of one application of the molten metal refinement system and containment vessel of this invention.

FIG. 2 is a front elevation view of the invention, illustrating the tub assembly 1, the refractory 4 lined metal inlet 2 and metal outlet 3, the dome lid front wall **6*a* and the front access door 7*a*. Further illustrated is the hydraulic cylinder assembly 8 for lifting and lowering the front access door 7*a*, the rotor tower mounts 10 and the gas exhaust ports 30**.

FIG. 2 further illustrates one of the side access doors **7*b*** raised and held in the open position, as illustrated by the broken lines.

Figure 3:
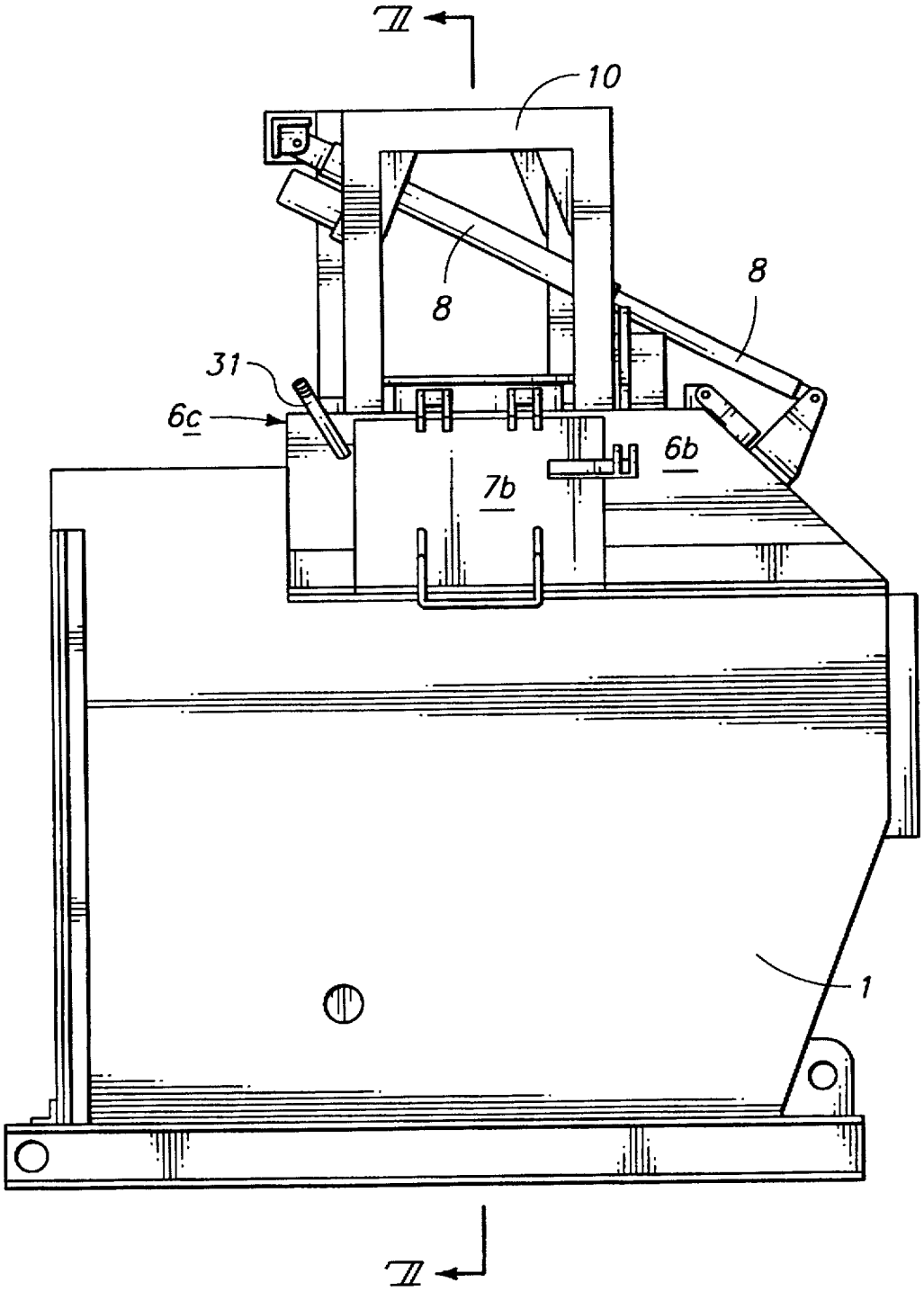
FIG. 3 is a left side elevation view of one application of the molten metal refinement system and containment vessel of this invention.

FIG. 3 is a left side elevation view, illustrating the tub assembly 1, the rotor tower mounts 10, the rear wall **6*c* of the dome lid, a side wall 6*b* of the dome lid, a side access door 7*b* and the hydraulic cylinder assembly 8**.

Figure 4:
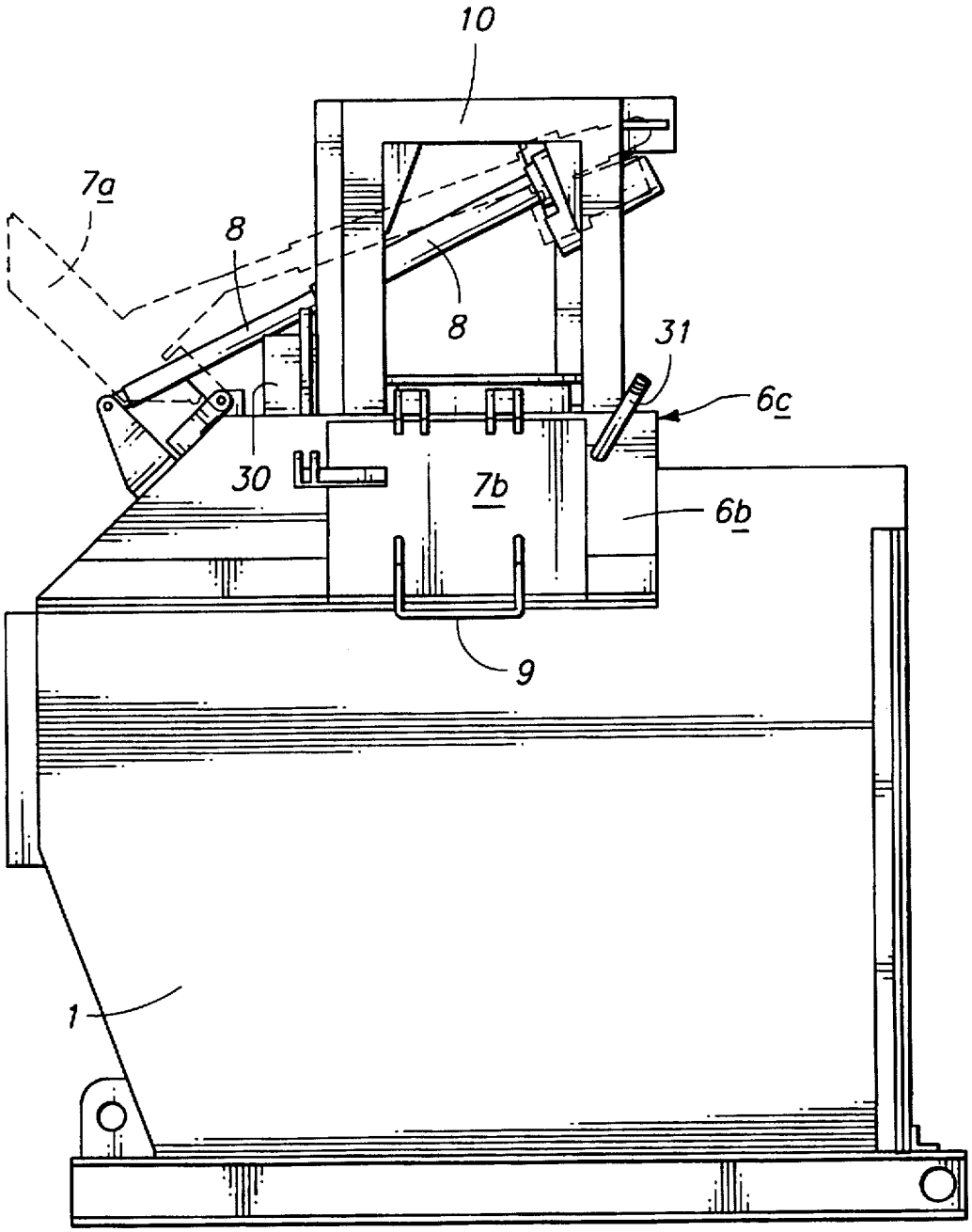
FIG. 4 is a right side elevation view of one application of the molten metal refinement system and containment vessel of this invention.

FIG. 4 is a right side elevation view, illustrating the tub assembly 1, the rotor tower mounts 10, the rear wall **6*c* of the dome lid, a side wall 6*b* of the dome lid, a side access door 7*b* and the hydraulic cylinder assembly 8. FIG. 4 further illustrates the front access door 7*a* raised and held in the open position by the hydraulic cylinder assembly 8**, as illustrated by the broken lines.

Figure 5:
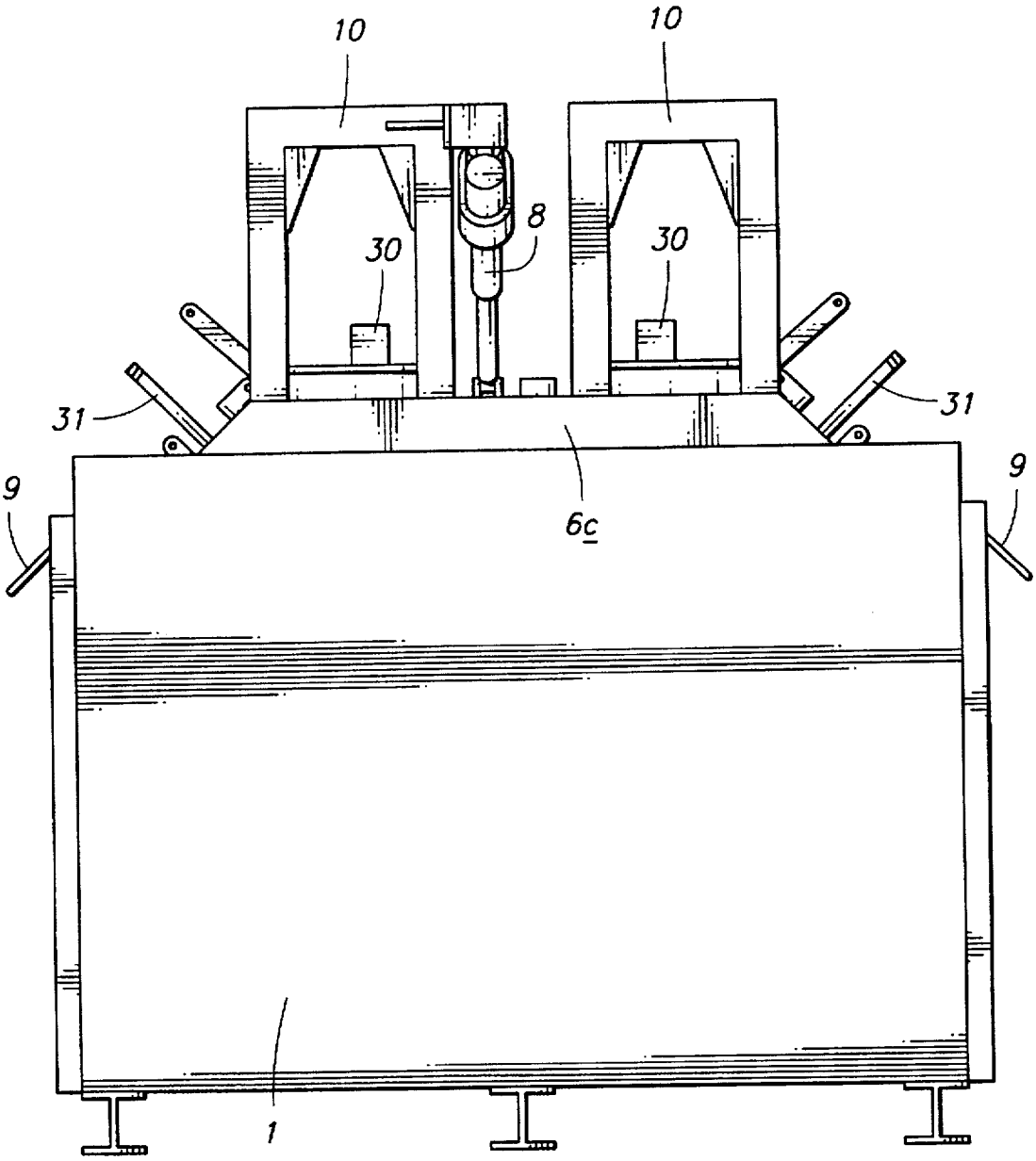
FIG. 5 is a rear side elevation view of one application of the molten metal refinement system and containment vessel of this invention.

FIG. 5 is a rear elevation view of the invention, illustrating the tub assembly 1, the rotor tower mounts 10, the rear wall **6*c* of the dome lid and the hydraulic cylinder assembly 8**.

Figure 6:
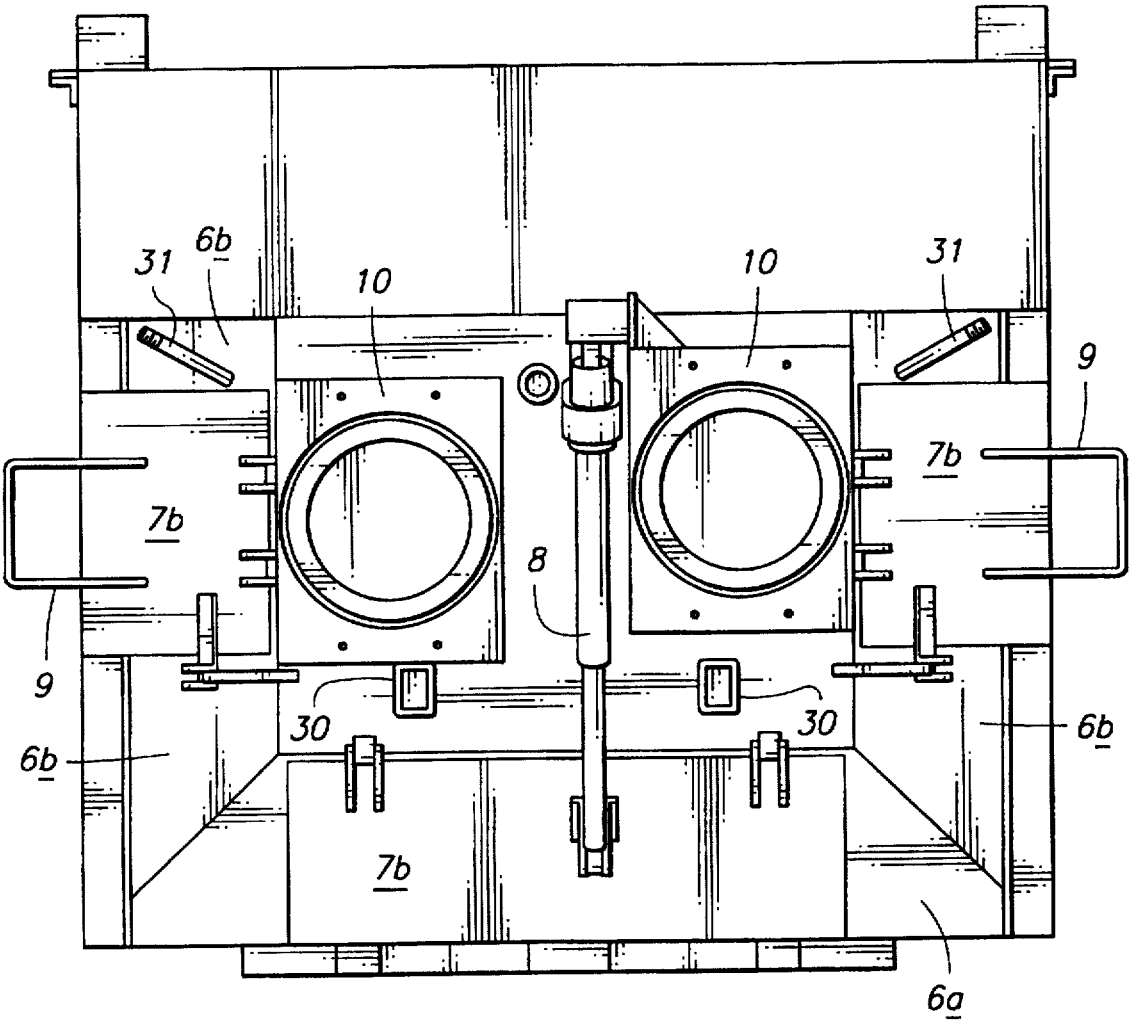
FIG. 6 is a top view of one application of the molten metal refinement system and containment vessel of this invention.

FIG. 6 is a top view of the refinement vessel without the rotary gas dispersion devices 12 installed thereon, illustrating the rotor tower mounts 10, the side walls **6*b* of the dome lid, the side access doors 7*b* and handles 9, the gas exhaust ports 30, the front wall 6*a* of the dome lid and the front access door 7*a***.

FIG. 7 illustrates the first refinement compartment 20, which is the first stage of metal refinement. Molten metal flowing through the first refinement compartment 20 then flows into the second refinement compartment 21 at the rear of the vessel, for the second stage of refinement. The separating or center baffle 25 separates the two refinement compartments and there is an opening between the two refinement compartments through which the metal flows from the first refinement compartment 20 to the second refinement compartment 21.

It should be noted that this invention also encompasses containment vessels in which there are more than two refinement compartments and vessels in which there are various baffle combinations designed to optimize the refining process. There are containment vessels, or tub assemblies, with three and four refinement compartments and there are tub assemblies wherein a refinement compartment has been partially partitioned into chambers using baffles in order to alter the flow characteristics and to impact the refinement. This invention applies to these various configurations as well.

FIG. 7 illustrates the rotary gas dispersion devices 12 used in the combination which this invention comprises, mounted on the tower mounts 10. Each of the rotary gas dispersion devices 12 include a cylindrical rotor 23 which are generally equipped with blades which are immersed in the molten metal during the processing or refinement of the metal. There is a hollow control shaft in the rotors of the rotary gas dispersion devices 12 for the supply of gas through the rotors and into the molten metal as the rotors spin. Blades on the end of the rotor **23*a*** assist in mixing and finely dispersing the gases which are introduced into the molten metal.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A dome lid assembly for use in combination with a molten metal refinement tub to form a containment vessel, the containment vessel being for use in combination with one or more rotary gas dispersion device to refine molten metal, the dome lid assembly comprising:

a. a lid body, comprised of:

i. four outer lid walls which form a lower outer surface which corresponds and attaches to an upper outer surface of a tub assembly;

ii. a roof which is integral with the four outer lid walls and which together form an interior cavity, the roof being elevated from lower ends of the four outer lid walls, and the roof including openings for receiving one or more rotary gas dispersion devices;

wherein the interior volume of the four outer lid walls and the roof is four cubic feet or more;

b. an access door to the interior cavity through two or more of the four outer walls;

c. a gas inlet port through the lid body; and d. a gas outlet port through the lid body.

2. A dome lid assembly as recited in claim 1, and which further comprises at least one access door to the interior cavity through at least three of the four outer walls.

3. A dome lid assembly as recited in claim 1, and in which three of the four outer walls of the lid body are inwardly sloping.

4. A dome lid assembly as recited in claim 1, and in which at least two of the four outer lid walls are inwardly sloping.

5. A molten metal containment vessel for use in combination with a rotary gas dispersion device to refine molten metal, and which comprises:

a. a containment vessel tub assembly;

b. a lid body, comprised of:

i. four outer lid walls which form a lower outer surface which corresponds and attaches to an upper outer surface of the tub assembly;

ii. a roof which is integral with the four outer lid walls and which together form an interior cavity, the roof being elevated from lower ends of the four outer lid walls, and the roof including openings for receiving two or more rotary gas dispersion devices;

wherein the interior volume of the four outer lid walls and the roof is four cubic feet or more;

c. an access door to the interior cavity through at least two of the four outer walls;

c. a gas inlet port through the lid body; and d. a gas outlet port through the lid body.

6. A molten metal containment vessel as recited in claim 5, and in which the containment vessel tub assembly further comprises:

a. a vessel having an inlet port and an outlet port; at least two refining compartments in between, connected in series, separated by a baffle, and positioned such that the first refining compartment is operatively connected to the metal inlet and the second refining compartment is operatively connected to the metal outlet.

7. A molten metal containment vessel as recited in claim 5, and in which at least two of the four outer lid walls are inwardly sloping.

8. A molten metal refinement vessel for refining molten metal, and which comprises:

a. a tub assembly;

b. a lid body, comprised of:

i. four outer lid walls which form a lower outer surface which corresponds and attaches to an upper outer surface of the tub assembly;

ii. a roof which is integral with the four outer lid walls and which together form an interior cavity, the roof being elevated from lower ends of the four outer lid walls, and the roof including openings for receiving two rotary gas dispersion devices;
wherein the interior volume of the four outer lid walls and the roof is four cubic feet or more;

c. an access door to the interior cavity through at least two of the four outer walls;

d. a first and a second rotary gas dispersion device mounted on the lid body, the first rotary gas dispersion device mounted above the first refining compartment and the second rotary gas dispersion device mounted above the second refining compartment;

e. a gas inlet port through the lid body; and f. a gas outlet port through the lid body.

9. A molten metal refinement vessel for refining molten metal as recited in claim 8, and which further comprises:

a. an exhaust gas control system operatively connected to the lid assembly at one or more gas exhaust ports.

10. A molten metal containment vessel as recited in claim 8, and in which at least two of the four outer lid walls are inwardly sloping.

11. An apparatus for refining molten aluminum, comprised of:

a. a two-stage refining vessel having an insulated shell with bottom and side walls impervious to molten aluminum, and which comprises:

i. a separating baffle member positioned so as to separate the space within said refining vessel into a first refining compartment and a second refining compartment;

ii. a first refining compartment within said refining vessel and having a front end, a back end and an outer side wall, said central baffle member comprising the inner side wall of said first refining compartment, which is capable of receiving a rotary gas dispersion device for the injection of sparging gas into molten aluminum during aluminum refining operation;

iii. an aluminum inlet in the first refining compartment for introducing molten aluminum thereto;

iv. a second refining compartment within said refining vessel and having a front end, a back end and an outer side wall;

v. an aluminum outlet in the second refining compartment for withdrawing molten aluminum therefrom;

vi. a cross-over opening in said separating baffle member through the first refining compartment to the second refining compartment during continuous aluminum refining operations within said second refining operations;

b. a lid body, comprised of:

i. four outer lid walls which form a lower outer surface which corresponds and attaches to an upper outer surface of the tub assembly;

ii. a roof which is integral with the four outer lid walls and which together form an interior cavity, the roof being elevated from lower ends of the four outer lid walls, and the roof including openings for receiving two rotary gas dispersion devices;
wherein the interior volume of the lid body is four cubic feet or more;

c. an access door to the interior cavity through at least two of the four outer walls;

d. a rotary gas dispensing device for treatment of a bath of molten aluminum in the first refining compartment and a rotary gas dispensing device for treatment of a bath of molten aluminum in a second refining compartments;

e. a gas inlet port through the lid body; and f. a gas outlet port through the lid body.

12. A molten metal containment vessel as recited in claim 11, and in which at least two of the four outer lid walls are inwardly sloping.

* * * * *